US011282478B2

(12) United States Patent
Yoo et al.

(10) Patent No.: US 11,282,478 B2
(45) Date of Patent: Mar. 22, 2022

(54) IMAGE DATA CORRECTING DEVICE, AND DISPLAY DEVICE INCLUDING THE SAME

(71) Applicant: Samsung Display Co., Ltd., Yongin-si (KR)

(72) Inventors: Byoung Seok Yoo, Seoul (KR); Hoi Sik Moon, Hwaseong-si (KR); Jeongwoon Lee, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 55 days.

(21) Appl. No.: 16/529,640

(22) Filed: Aug. 1, 2019

(65) Prior Publication Data

US 2020/0090625 A1 Mar. 19, 2020

(30) Foreign Application Priority Data

Sep. 13, 2018 (KR) ..... 10-2018-0109882

(51) Int. Cl.
*G09G 5/10* (2006.01)

(52) U.S. Cl.
CPC ..... *G09G 5/10* (2013.01); *G09G 2320/0233* (2013.01); *G09G 2360/16* (2013.01)

(58) Field of Classification Search
CPC ..... G09G 5/10; G09G 2360/16; G09G 2320/0233; G09G 2360/122; G09G 2320/0693; G09G 5/02; G09G 2320/0271; G09G 3/20; G09G 5/00; G09G 2320/0686
See application file for complete search history.

(56) References Cited

U.S. PATENT DOCUMENTS

| | | | | |
|---|---|---|---|---|
| 9,805,686 | B2 | 10/2017 | Jung et al. | |
| 2011/0012908 | A1 | 1/2011 | Daly | |
| 2017/0243562 | A1* | 8/2017 | Hu | G09G 5/10 |
| 2018/0191371 | A1* | 7/2018 | Tao | G06F 3/147 |

FOREIGN PATENT DOCUMENTS

| | | | | |
|---|---|---|---|---|
| KR | 10-2014-0093011 | A | | 7/2014 |
| KR | 10-2015-0030013 | A | | 3/2015 |
| KR | 10-1611919 | B1 | | 4/2016 |
| KR | 10-2016-0068101 | A | | 6/2016 |
| KR | 20190027266 | A | * | 3/2019 |

* cited by examiner

*Primary Examiner* — Patrick N Edouard
*Assistant Examiner* — Joseph P Fox
(74) *Attorney, Agent, or Firm* — Lewis Roca Rothgerber Christie LLP

(57) ABSTRACT

An image data correcting device included in a display device includes a correction data memory and a correction calculator. The correction data memory stores sampling window select information indicating a sampling window selected from a plurality of sampling windows that are different from each other, and correction data obtained utilizing the selected sampling window with respect to the display device. The correction calculator receives image data, and corrects the image data based on the correction data for pixels at positions corresponding to the selected sampling window indicated by the sampling window select information.

17 Claims, 11 Drawing Sheets

FIG. 2

| SAMPLING WINDOW | 1x64 | 2x32 | 8x8 | 32x2 | 64x1 |
|---|---|---|---|---|---|
| MEMORY SIZE | 10.7Mbit | 10.7Mbit | 10.4Mbit | 10.4Mbit | 10.5Mbit |

FIG. 4

DISPLAY RESOLUTION = 3840x2160(UD)
SAMPLING WINDOW = 2x32

| | X=0 | X=1 | X=3 | X=4 | … | X=3838 | X=3839 |
|---|---|---|---|---|---|---|---|
| Y=0 | P0=0<br>P1=1<br>P2=1921<br>P3=1922 | P0=0<br>P1=1<br>P2=1921<br>P3=1922 | P0=1<br>P1=2<br>P2=1922<br>P3=1923 | P0=1<br>P1=2<br>P2=1922<br>P3=1923 | … | P0=1919<br>P1=1920<br>P2=3840<br>P3=3841 | P0=1919<br>P1=1920<br>P2=3840<br>P3=3841 |
| … | … | … | … | … | … | … | … |
| Y=31 | P0=0<br>P1=1<br>P2=1921<br>P3=1922 | P0=0<br>P1=1<br>P2=1921<br>P3=1922 | P0=1<br>P1=2<br>P2=1922<br>P3=1923 | P0=1<br>P1=2<br>P2=1922<br>P3=1923 | … | P0=1919<br>P1=1920<br>P2=3840<br>P3=3841 | P0=1919<br>P1=1920<br>P2=3840<br>P3=3841 |
| Y=32 | P0=1921<br>P1=1922<br>P2=3842<br>P3=3843 | P0=1921<br>P1=1922<br>P2=3842<br>P3=3843 | P0=1922<br>P1=1923<br>P2=3843<br>P3=3844 | P0=1922<br>P1=1923<br>P2=3843<br>P3=3844 | … | P0=3840<br>P1=3841<br>P2=5761<br>P3=5762 | P0=3840<br>P1=3841<br>P2=5761<br>P3=5762 |
| … | … | … | … | … | … | … | … |
| Y=2158 | P0=128707<br>P1=128708<br>P2=130628<br>P3=130629 | P0=128707<br>P1=128708<br>P2=130628<br>P3=130629 | P0=128708<br>P1=128709<br>P2=130629<br>P3=130630 | P0=128708<br>P1=128709<br>P2=130629<br>P3=130630 | … | P0=130626<br>P1=130627<br>P2=132547<br>P3=132548 | P0=130626<br>P1=130627<br>P2=132547<br>P3=132548 |
| Y=2159 | P0=128707<br>P1=128708<br>P2=130628<br>P3=130629 | P0=128707<br>P1=128708<br>P2=130628<br>P3=130629 | P0=128708<br>P1=128709<br>P2=130629<br>P3=130630 | P0=128708<br>P1=128709<br>P2=130629<br>P3=130630 | … | P0=130626<br>P1=130627<br>P2=132547<br>P3=132548 | P0=130626<br>P1=130627<br>P2=132547<br>P3=132548 |

FIG. 7

| | 0G | 16G | 24G | 32G | 64G | 128G | 160G | 192G | 244G | 255G |
|---|---|---|---|---|---|---|---|---|---|---|
| SAMPLINE WINDOW | 4x4 | 4x4 | 4x8 | 8x8 | 16x16 | 16x16 | 16x16 | 32x32 | 32x32 | 64x64 |

IMAGE DATA CORRECTING DEVICE, AND DISPLAY DEVICE INCLUDING THE SAME

CROSS-REFERENCE TO RELATED APPLICATION

This application claims priority to and the benefit of Korean Patent Application No. 10-2018-0109882 filed on Sep. 13, 2018 in the Korean Intellectual Property Office (KIPO), the entire content of which is incorporated herein by reference.

BACKGROUND

1. Field

An embodiment of the present invention relates to display devices, and more particularly to image data correcting devices, and display devices including the image data correcting devices.

2. Description of the Related Art

Even if a plurality of pixels included in a display device are manufactured by the same process, the plurality of pixels may have different luminance due to a process variation, and/or the like, and thus a mura defect may occur in the display device. To reduce or eliminate the mura defect, and to improve luminance uniformity of the display device, an image displayed by the display device in a module state may be captured, correction data may be generated based on the captured image, and the correction data may be stored in the display device. The display device may correct image data based on the stored correction data, and may display an image based on the corrected image data, thereby displaying the image with uniform luminance and without the mura defect.

To prevent or protect from a takt time for the display device and a storage space for the correction data from being excessively increased, the correction data may be obtained and stored not on a pixel-by-pixel basis, but on a sampling window-by-sampling window basis, and a sampling window may correspond to a plurality of pixels. With respect to related art display devices, a single square sampling window, e.g., an 8*8 sampling window may be used to capture, store and use the correction data, and thus optimal or desired mura correction may not be performed for all different display devices.

SUMMARY

Aspects of some example embodiments are directed toward an image data correcting device capable of performing optimal or desired mura correction.

Aspects of some example embodiments are directed toward a display device including an image data correcting device capable of performing optimal or desired mura correction.

According to example embodiments, there is provided an image data correcting device included in a display device including a correction data memory configured to store sampling window select information indicating a sampling window selected from a plurality of sampling windows that are different from each other, and correction data obtained utilizing the selected sampling window with respect to the display device, and a correction calculator configured to receive image data, and to correct the image data based on the correction data for pixels at positions corresponding to the selected sampling window indicated by the sampling window select information.

In example embodiments, the selected sampling window indicated by the sampling window select information may be selected based on a luminance distribution of the display device from among the plurality of sampling windows.

In example embodiments, the plurality of sampling windows may have different row direction lengths and different column direction lengths, and may have a same size.

In example embodiments, a display panel of the display device may be divided into a plurality of pixel blocks, each corresponding to the selected sampling window indicated by the sampling window select information, and the correction data stored in the correction data memory may include, with respect to each pixel block, a pixel correction data at a plurality of reference gray levels for a representative pixel from among the pixels included in the each pixel block.

In example embodiments, the representative pixel may be a pixel located at a top left corner from among the pixels included in the each pixel block.

In example embodiments, the sampling window select information may include a row direction length and a column direction length of the selected sampling window.

In example embodiments, a display panel of the display device may be divided into a plurality of pixel blocks based on the selected sampling window, and the correction data may include a plurality of pixel correction data for a plurality of representative pixels respectively corresponding to the plurality of pixel blocks. The correction calculator may extract, with respect to each pixel of the display panel, the plurality of pixel correction data for the representative pixels that are adjacent to the each pixel based on the row direction length of the selected sampling window, the column direction length of the selected sampling window, a row direction position of the each pixel, and a column direction position of the each pixel, and may correct the image data for the each pixel by performing a bilinear interpolation on the pixel correction data for the adjacent representative pixels.

In example embodiments, the correction calculator may extract the pixel correction data for the adjacent representative pixels utilizing equations, $P0=(\lfloor X/X_SIZE \rfloor)+(\lfloor Y/Y_SIZE \rfloor)*(\lceil NUM_COL/X_SIZE \rceil+1)$, $P1=(\lfloor X/X_SIZE \rfloor+1)+(\lfloor Y/Y_SIZE \rfloor)*(\lceil NUM_COL/X_SIZE \rceil+1)$, $P2=(\lfloor X/X_SIZE \rfloor)+(\lfloor Y/Y_SIZE \rfloor+1)*(\lceil NUM_COL/X_SIZE \rceil+1)$, and $P3=(\lfloor X/X_SIZE \rfloor+1)+(\lfloor Y/Y_SIZE \rfloor+1)*(\lceil NUM_COL/X_SIZE \rceil+1)$, where P0, P1, P2 and P3 represent indexes of the pixel correction data for the adjacent representative pixels, X_SIZE represents the row direction length of the selected sampling window, Y_SIZE represents the column direction length of the selected sampling window, X represents the row direction position of the each pixel, Y represents the column direction position of the each pixel, and NUM_COL represents a number of pixel columns of the display panel.

In example embodiments, the correction calculator may perform the bilinear interpolation utilizing an equation, $CD[P0]+((X \% X_SIZE)/X_SIZE))*(CD[P1]-CD[P0])+((Y \% Y_SIZE)/Y_SIZE))*(CD[P2]-CD[P0])+((X \% X_SIZE)*(Y \% Y_SIZE)/X_SIZE*Y_SIZE))*(CD[P0]+CD[P3]-CD[P1]-CD[P2])$, where CD[P0], CD[P1], CD[P2] and CD[P3] are the pixel correction data having the indexes of P0, P1, P2 and P3.

In example embodiments, the correction calculator may perform the bilinear interpolation at each of a plurality of reference gray levels, and the correction calculator may correct the image data for the each pixel by further performing a linear interpolation between gray levels on results of the bilinear interpolation at the plurality of reference gray levels.

According to example embodiments, there is provided an image data correcting device included in a display device including a correction data memory configured to store correction data that is obtained with respect to the display device utilizing a plurality of sampling windows at a plurality of reference gray levels, respectively, and a correction calculator configured to receive image data, to select at least one sampling window according to a gray level of the image data from among the plurality of sampling windows, and to correct the image data based on the correction data for pixels at positions corresponding to the selected sampling window.

In example embodiments, the plurality of reference gray levels may include a first reference gray level, and a second reference gray level higher than the first reference gray level, and the plurality of sampling windows may include a first sampling window corresponding to the first reference gray level, and a second sampling window corresponding to the second reference gray level. The second sampling window may be greater in size than that of the first sampling window.

In example embodiments, the correction calculator may include a plurality of correction data buffers configured to temporarily store the correction data at the plurality of reference gray levels, a space interpolator configured to generate the correction data for all the pixels included in a display panel of the display device by performing, with respect to each pixel of the display panel, a bilinear interpolation on a plurality of pixel correction data for representative pixels that are adjacent to the each pixel from among the plurality of pixel correction data included in the correction data at each of the plurality of reference gray levels, and a gray interpolator configured to receive, with respect to the each pixel, the correction data at two of the reference gray levels that are adjacent to the gray level of the image data for the each pixel from among the correction data at the plurality of reference gray levels from the space interpolator, and to correct the image data for the each pixel by performing a linear interpolation on the correction data at the two of the reference gray levels.

In example embodiments, the plurality of reference gray levels may include a first reference gray level, and a second reference gray level higher than the first reference gray level, and the plurality of correction data buffers may include a first correction data buffer configured to temporarily store the correction data at the first reference gray level, and a second correction data buffer configured to temporarily store the correction data at the second reference gray level. The second correction data buffer may be less in size than that of the first correction data buffer.

In example embodiments, the plurality of correction data buffers includes two correction data buffers per each of the plurality of reference gray levels, and each of the two correction data buffers may temporarily store the correction data corresponding to representative pixels in one row, and may update one of the two correction data buffers each time the image data for the pixels in rows corresponding to a column direction length of the sampling window corresponding to each of the plurality of reference gray levels are received.

In example embodiments, the space interpolator may perform the bilinear interpolation utilizing an equation, "CD[P0]+((X % X_SIZE)/X_SIZE))*(CD[P1]−CD[P0])+((Y % Y_SIZE)/Y_SIZE))*(CD[P2]−CD[P0])+((X % X_SIZE)*(Y % Y_SIZE)/X_SIZE*Y_SIZE))*(CD[P0]+CD[P3]−CD[P1]−CD[P2])", where P0, P1, P2 and P3 represent indexes of the pixel correction data for the adjacent representative pixels, CD[P0], CD[P1], CD[P2] and CD[P3] are the pixel correction data having the indexes of P0, P1, P2 and P3, X_SIZE represents a row direction length of the sampling window, Y_SIZE represents a column direction length of the sampling window, X represents a row direction position of the each pixel, Y represents a column direction position of the each pixel, and NUM_COL represents a number of pixel columns of the display panel.

In example embodiments, the gray interpolator may perform the linear interpolation on the correction data at the two of the reference gray levels utilizing an equation, "Y1+(X_I−X1)*(Y2−Y1)/(X2−X1)", where X_I represents the image data for the each pixel, X1 represents a first reference gray level among the two of the reference gray levels, X2 represents a second reference gray level among the two of the reference gray levels, Y1 represents the correction data for the each pixel at the first reference gray level, and Y2 represents the correction data for the each pixel at the second reference gray level.

According to example embodiments, there is provided a display device including a display panel including pixels, an image data correcting device including a correction data memory configured to store correction data, and a correction calculator configured to receive image data, to select a sampling window from among a plurality of sampling windows that are different from each other, and to correct the image data based on the correction data for the pixels at positions corresponding to the selected sampling window, and a data driver configured to generate data signals based on the corrected image data, and to provide the data signals to the pixels.

In example embodiments, the correction data memory may further store sampling window select information indicating the selected sampling window, and the correction calculator may select the sampling window based on the sampling window select information from among the plurality of sampling windows.

In example embodiments, the correction calculator may select the sampling window according to a gray level of the image data from among the plurality of sampling windows.

As described above, the image data correcting device and the display device including the image data correcting device according to example embodiments may correct image data based on correction data that are obtained using a sampling window selected based on a luminance distribution of the display device among a plurality of sampling windows, thereby performing optimal or desired mura correction suitable for each display device.

Further, the image data correcting device and the display device including the image data correcting device according to example embodiments may correct image data based on correction data that are obtained using a plurality of sampling windows respectively at a plurality of reference gray levels, thereby performing optimal or desired mura correction suitable for a gray level of image data.

BRIEF DESCRIPTION OF THE DRAWINGS

Illustrative, non-limiting example embodiments will be more clearly understood from the following detailed description in conjunction with the accompanying drawings.

FIG. 2 is a diagram illustrating an example of difference sampling windows that are to be selected according to a luminance distribution of a display device.

FIG. 4 is a diagram for describing an example of extracting pixel correction data used in correcting image data for each pixel in a case where mura correction is performed using a 2*32 sampling window with respect to a display device having a display resolution of 3820*2160.

FIG. 7 is a diagram illustrating an example of a plurality of sampling windows respectively corresponding to a plurality of reference gray levels.

DETAILED DESCRIPTION

Hereinafter, embodiments of the present inventive concept will be explained in detail with reference to the accompanying drawings.

Figure 1:
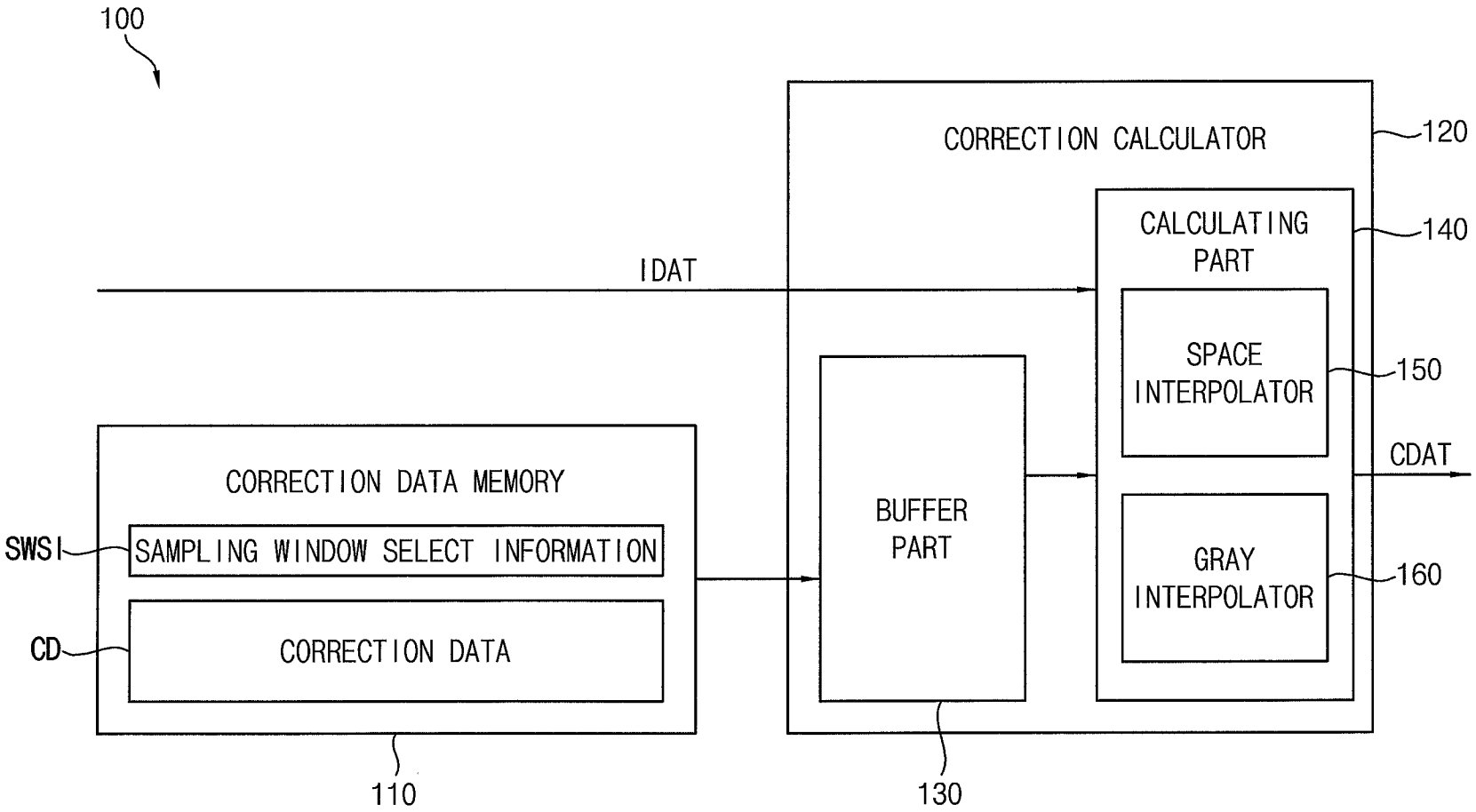
FIG. 1 is a block diagram illustrating an image data correcting device according to example embodiments.
Figure 3A:
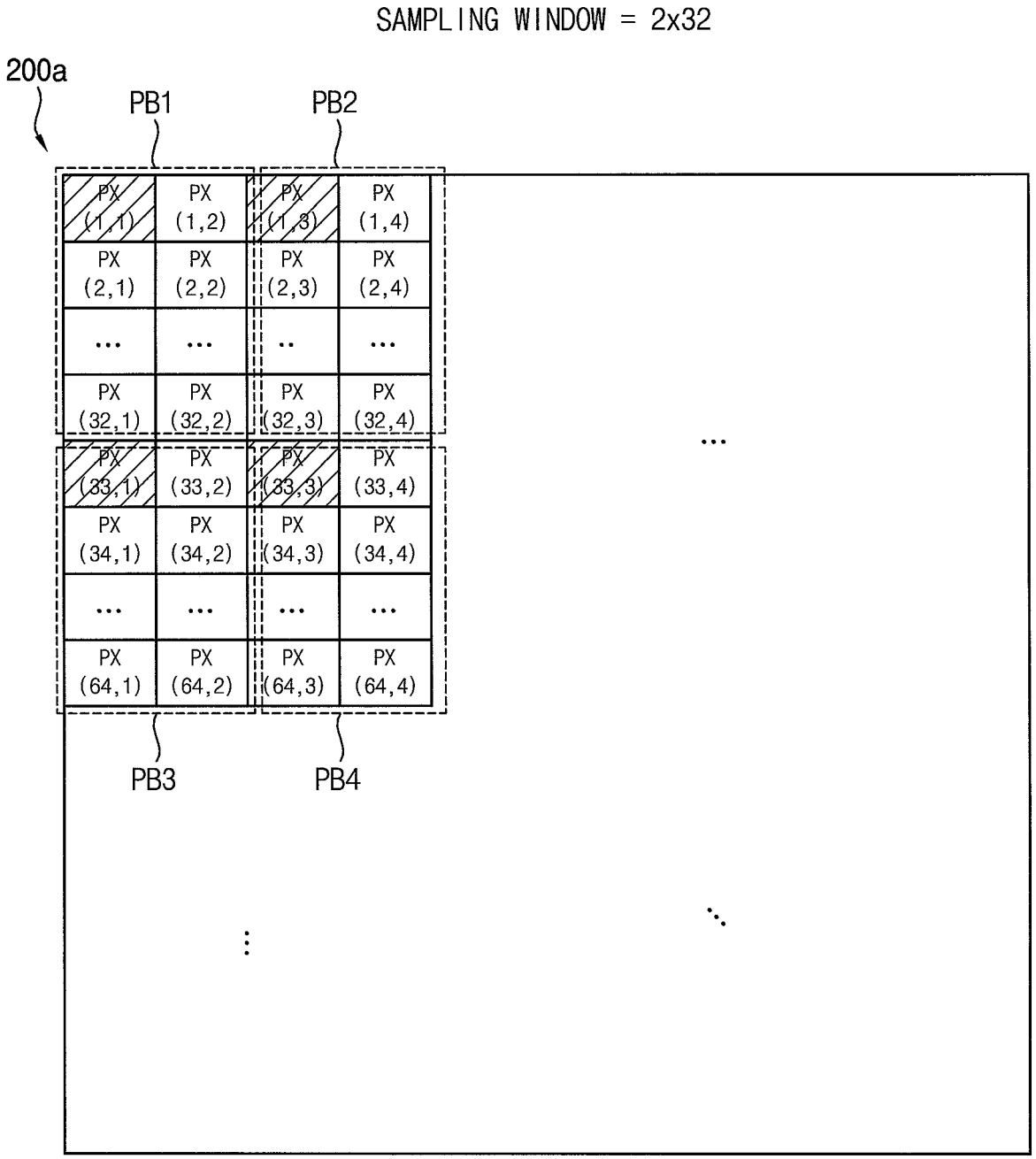
FIG. 3A is a diagram for describing an example of correction data obtained using a 2*32 sampling window.
Figure 3B:
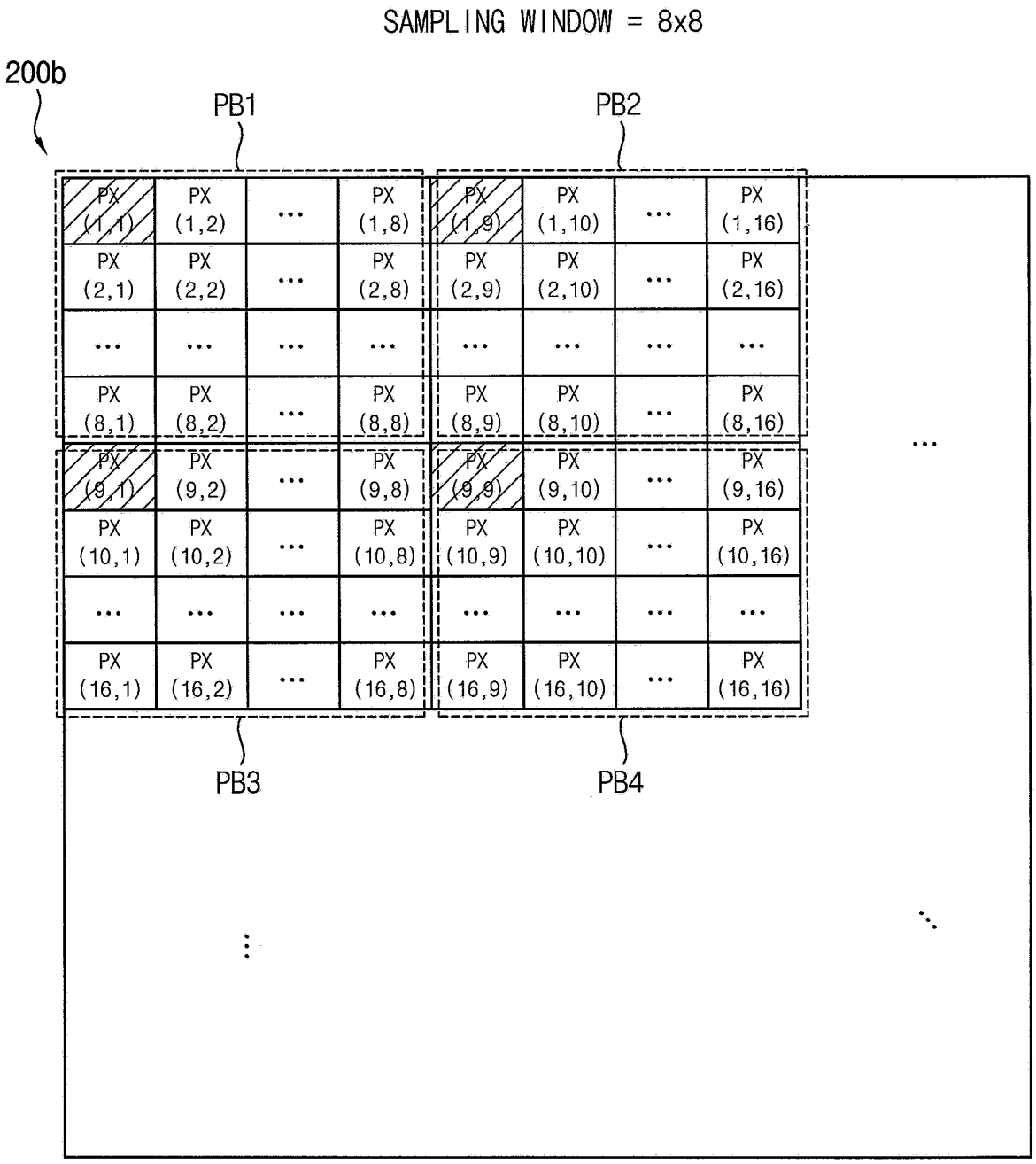
FIG. 3B is a diagram for describing an example of correction data obtained using an 8*8 sampling window.
Figure 3C:
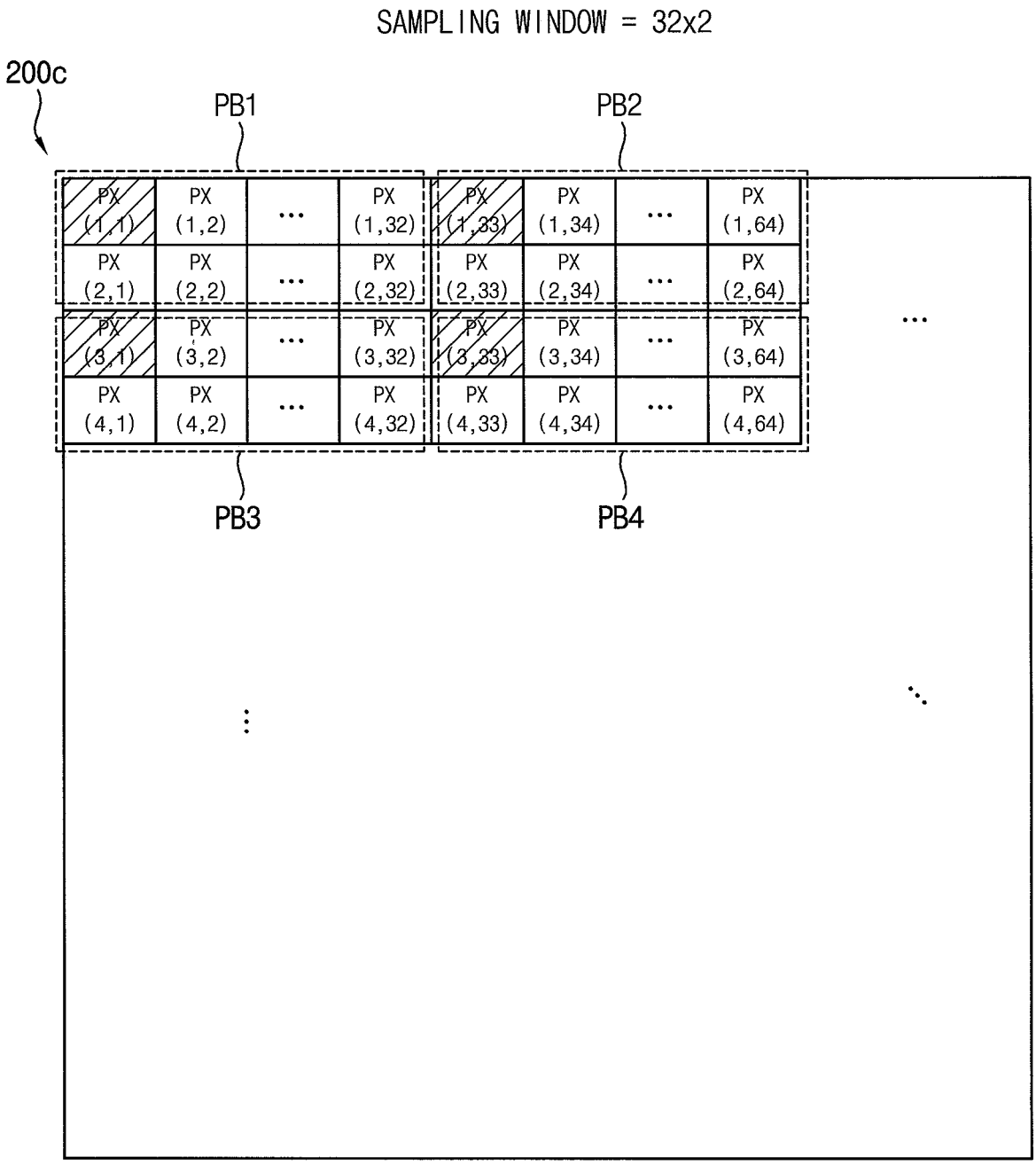
FIG. 3C is a diagram for describing an example of correction data obtained using a 32*2 sampling window.
Figure 5:
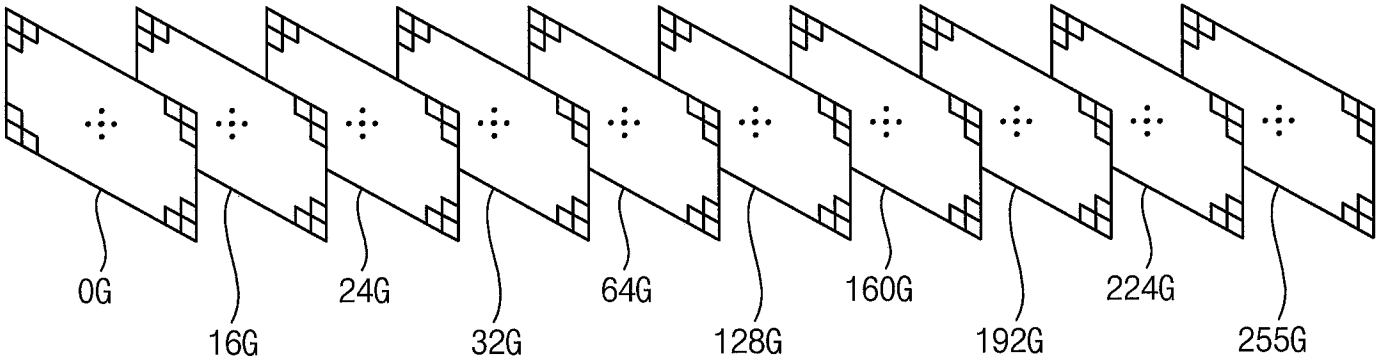
FIG. 5 is a diagram for describing an example of a plurality of reference gray levels at which correction data are obtained.

FIG. 1 is a block diagram illustrating an image data correcting device according to example embodiments. FIG. 2 is a diagram illustrating an example of difference sampling windows that may be selected according to a luminance distribution of a display device. FIG. 3A is a diagram for describing an example of correction data obtained using a 2*32 sampling window. FIG. 3B is a diagram for describing an example of correction data obtained using an 8*8 sampling window. FIG. 3C is a diagram for describing an example of correction data obtained using a 32*2 sampling window. FIG. 4 is a diagram for describing an example of extracting pixel correction data used in correcting image data for each pixel in a case where mura correction is performed using a 2*32 sampling window with respect to a display device having a display resolution of 3820*2160. FIG. 5 is a diagram for describing an example of a plurality of reference gray levels at which correction data are obtained.

Referring to FIG. 1, an image data correcting device 100 included in a display device according to example embodiments may include a correction data memory 110 and a correction calculator 120.

The correction data memory 110 may store sampling window select information SWSI indicating a sampling window selected from a plurality of sampling windows that are different from each other, and correction data CD obtained using the selected sampling window with respect to the display device. In some example embodiments, the correction data memory 110 may be a nonvolatile memory, such as a flash memory, or the like. In other example embodiments, the correction data memory 110 may be a volatile memory, such as a dynamic random access memory (DRAM), a static random access memory (SRAM), or the like. In this case, the sampling window select information SWSI and the correction data CD may be stored in an external nonvolatile memory, and may be loaded into the correction data memory 110 when the display device operates.

In some example embodiments, the sampling window indicated by the sampling window select information SWSI may be selected based on a luminance distribution of the display device among the plurality of sampling windows. For example, as illustrated in FIG. 2, the sampling window indicated by the sampling window select information SWSI may be selected according to the luminance distribution of the display device, or a shape of a mura defect of the display device among a 1*64 sampling window, a 2*32 sampling window, an 8*8 sampling window, a 32*2 sampling window and a 64*1 sampling window. In an example, the 1*64 sampling window may be selected with respect to the display device having a mura defect extending in a column direction, the 8*8 sampling window may be selected with respect to the display device having a square-shaped mura defect, and the 64*1 sampling window may be selected with respect to the display device having a mura defect extending in a row direction. Thus, the sampling window may be selected suitable for respective display devices having different luminance distributions (or mura defects having different shapes).

Further, in some example embodiments, the sampling window indicated by the sampling window select information SWSI may be selected from the plurality of sampling windows having different row direction lengths and different column direction lengths and having substantially the same size. For example, as illustrated in FIG. 2, the 1*64 sampling window, the 2*32 sampling window, the 8*8 sampling window, the 32*2 sampling window and the 64*1 sampling window may have different row direction lengths and different column direction lengths, but may have substantially the same size corresponding to 64 pixels. Accordingly, although different sampling windows are selected with respect to different display devices, because the different sampling windows have substantially the same size, the correction data CD obtained using the different sampling windows may have substantially the same size, and the display devices may include the correction data memory 110 having substantially the same size. For example, as illustrated in FIG. 2, in a case where the display device has a display resolution of about 3820*2160 (i.e., a ultra definition (UD) resolution), the correction data CD obtained using the 1*64 sampling window, the 2*32 sampling window, the 8*8 sampling window, the 32*2 sampling window and the 64*1 sampling window may have substantially the same data size, for example about 10.5 Mbits to about 10.7 Mbits. Accordingly, although different sampling windows are applied to display devices, the display devices may use the correction data memory 110 having substantially the same memory size. Although FIG. 2 illustrates an example of five sampling windows, example embodiments may not be limited to the example of FIG. 2.

In some example embodiments, the sampling window select information SWSI may include a row direction length and a column direction length of the selected sampling window. For example, the sampling window select information SWSI may indicate a row direction length of 1 and a column direction length of 64 in a case where the 1*64 sampling window is selected, may indicate a row direction length of 2 and a column direction length of 32 in a case where the 2*32 sampling window is selected, may indicate a row direction length of 8 and a column direction length of 8 in a case where the 8*8 sampling window is selected, may indicate a row direction length of 32 and a column direction length of 2 in a case where the 32*2 sampling window is selected, and may indicate a row direction length of 64 and a column direction length of 1 in a case where the 64*1 sampling window is selected.

The correction data CD stored in the correction data memory 110 may be obtained using the selected sampling window indicated by the sampling window select information SWSI. For example, when the display device is manufactured, an image displayed by the display device may be captured. A display panel of the display device may be divided into a plurality of pixel blocks each corresponding to the selected sampling window, and the correction data CD at one position per each pixel block may be obtained based on the captured image. According to example embodiments, the correction data CD at the one position per each pixel block may be correction data generated based on a maximum luminance, a minimum luminance or an average luminance of pixels included in the pixel block, or may be pixel correction data for one representative pixel among pixels included in the pixel block.

For example, as illustrated in FIG. 3A, in a case where the 2*32 sampling window is selected, a display panel 200*a* of the display device may be divided into a plurality of pixel blocks PB1, PB2, PB3 and PB4 each corresponding to the 2*32 sampling window, and the correction data CD stored in the correction data memory 110 may include correction data at one position per each pixel block PB1, PB2, PB3 and PB4. In some example embodiments, the correction data CD stored in the correction data memory 110 may include, with respect to each pixel block (e.g., PB1), pixel correction data for one representative pixel (e.g., PX(1,1)) among pixels (e.g., PX(1,1) through PX(32,2)) included in the each pixel block (e.g., PB1). For example, as illustrated in FIG. 3A, the correction data CD may include, per each pixel block (e.g., PB1), the pixel correction data for a pixel (e.g., PX(1,1)) located at a top left corner among the pixels (e.g., PX(1,1) through PX(32,2)) included in the each pixel block (e.g., PB1). For example, as illustrated in FIG. 3A, the correction data CD may include pixel correction data for a representative pixel PX(1,1) in a first pixel row and a first pixel column with respect to a first pixel block PB1 including pixels PX(1,1) through PX(32,2) in first through thirty-second pixel rows and first and second pixel columns. The correction data CD may also include pixel correction data for a representative pixel PX(1,3) in the first pixel row and a third pixel column with respect to a second pixel block PB2 including pixels PX(1,3) through PX(32,4) in the first through thirty-second pixel rows and third and fourth pixel columns. The correction data CD may further include pixel correction data for a representative pixel PX(33,1) in a thirty-third pixel row and the first pixel column with respect to a third pixel block PB3 including pixels PX(33,1) through PX(64,2) in thirty-third through sixty-fourth pixel rows and the first and second pixel columns. The correction data CD may include pixel correction data for a representative pixel PX(33,3) in the thirty-third pixel row and the third pixel column with respect to a fourth pixel block PB4 including pixels PX(33,3) through PX(64,4) in the thirty-third through sixty-fourth pixel rows and the third and fourth pixel columns. Further, in some example embodiments, the pixel correction data for the representative pixel may be obtained at a plurality of reference gray levels (e.g., as illustrated in FIG. 5, 0-gray level 0G, 16-gray level 16G, 24-gray level 24G, 32-gray level 32G, 64-gray level 64G, 128-gray level 128G, 160-gray level 160G, 192-gray level 192G, 224-gray level 224G and 255-gray level 255G).

In another example, as illustrated in FIG. 3B, in a case where the 8*8 sampling window is selected, a display panel 200*b* of the display device may be divided into a plurality of pixel blocks PB1, PB2, PB3 and PB4 each corresponding to the 8*8 sampling window, and the correction data CD stored in the correction data memory 110 may include correction data at one representative pixel PX(1,1), PX(1,9), PX(9,1) and PX(9,9) located at a top left corner per each pixel block PB1, PB2, PB3 and PB4. For example, as illustrated in FIG. 3B, the correction data CD may include pixel correction data for a representative pixel PX(1,1) in a first pixel row and a first pixel column with respect to a first pixel block PB1 including pixels PX(1,1) through PX(8,8) in first through eighth pixel rows and first through eighth pixel columns. The correction data CD may also include pixel correction data for a representative pixel PX(1,9) in the first pixel row and a ninth pixel column with respect to a second pixel block PB2 including pixels PX(1,9) through PX(8,16) in the first through eighth pixel rows and ninth through sixteenth pixel columns. The correction data CD may further include pixel correction data for a representative pixel PX(9,1) in a ninth pixel row and the first pixel column with respect to a third pixel block PB3 including pixels PX(9,1) through PX(16,8) in ninth through sixteenth pixel rows and the first through eighth pixel columns. The correction data CD may include pixel correction data for a representative pixel PX(9,9) in the ninth pixel row and the ninth pixel column with respect to a fourth pixel block PB4 including pixels PX(9,9) through PX(16,16) in the ninth through sixteenth pixel rows and ninth through sixteenth pixel columns.

In still another example, as illustrated in FIG. 3C, in a case where the 32*2 sampling window is selected, a display panel 200*c* of the display device may be divided into a plurality of pixel blocks PB1, PB2, PB3 and PB4 each corresponding to the 32*2 sampling window, and the correction data CD stored in the correction data memory 110 may include correction data at one representative pixel PX(1,1), PX(1,33), PX(3,1) and PX(3,33) located at a top left corner per each pixel block PB1, PB2, PB3 and PB4. For example, as illustrated in FIG. 3C, the correction data CD may include pixel correction data for a representative pixel PX(1,1) in a first pixel row and a first pixel column with respect to a first pixel block PB1 including pixels PX(1,1) through PX(2,32) in first and second pixel rows and first through thirty-second pixel columns. The correction data CD may also include pixel correction data for a representative pixel PX(1,33) in the first pixel row and a thirty-third pixel column with respect to a second pixel block PB2 including pixels PX(1,33) through PX(2,64) in the first and second pixel rows and thirty-third through sixty-fourth pixel columns. The correction data CD may further include pixel correction data for a representative pixel PX(3,1) in a third pixel row and the first pixel column with respect to a third pixel block PB3 including pixels PX(3,1) through PX(4,32) in third and fourth pixel rows and the first through thirty-second pixel columns. The correction data CD may include pixel correction data for a representative pixel PX(3,33) in the third pixel row and the thirty-third pixel column with respect to a fourth pixel block PB4 including pixels PX(3,33) through PX(4,64) in the third and fourth pixel rows and thirty-third through sixty-fourth pixel columns.

The correction calculator 120 may receive image data IDAT from an external host processor (e.g., a graphic processing unit (GPU) or a graphic card), may correct the image data IDAT based on the correction data CD for pixels at positions corresponding to the selected sampling window indicated by the sampling window select information SWSI, and may provide the corrected image data CDAT to a controller of the display device. In some example embodiments, the correction calculator 120 may include, but not be limited to, a buffer part 130 that temporarily stores the correction data CD, and a calculating part 140 that corrects the image data DAT based on the correction data CD stored in the buffer part 130. In some example embodiments, the calculating part 140 may include a space interpolator 150 that performs a bilinear interpolation on the correction data CD for different representative pixels, and a gray interpolator 160 that performs a linear interpolation on the correction data CD at different reference gray levels.

In some example embodiments, as described above, a display panel of the display device may be divided into a plurality of pixel blocks based on the selected sampling window, and the correction data CD may include a plurality of pixel correction data for a plurality of representative pixels respectively corresponding to the plurality of pixel blocks. Further, the correction calculator 120 (e.g., the space interpolator 150) may extract, with respect to each pixel of the display panel, the pixel correction data for the representative pixels adjacent to each pixel based on the row direction length of the selected sampling window, the column direction length of the selected sampling window, a row direction position of the each pixel, and a column direction position of the each pixel, and may correct the image data for the each pixel by performing the bilinear interpolation on the pixel correction data for the adjacent representative pixels.

For example, the plurality of pixel correction data for the plurality of representative pixels may be stored with one-dimensional indexes in the correction data memory. Thus, in case of the example of FIG. 3A, the pixel correction data for representative pixels PX(1,1) and PX(1,3) in a first pixel row may be stored not with two-dimensional indexes (e.g., (1,1) and (1,2)), but with one-dimensional indexes, for example indexes of 0 and 1, and the pixel correction data for representative pixels PX(33,1) and PX(33,3) in a thirty-third pixel row may be stored not with two-dimensional indexes (e.g., (2,1) and (2,2)), but with one-dimensional indexes, for example indexes of 1921 and 1922. Further, the correction calculator 120 (e.g., the space interpolator 150) may extract the pixel correction data for the adjacent representative pixels by calculating the indexes of the pixel correction data using equations, "$P0=(\lfloor X/X_SIZE \rfloor)+(\lfloor Y/Y_SIZE \rfloor)*(\lceil NUM_COL/X_SIZE \rceil+1)$", "$P1=(\lfloor X/X_SIZE \rfloor+1)+(\lfloor Y/Y_SIZE \rfloor)*(\lceil NUM_COL/X_SIZE \rceil+1)$", "$P2=(\lfloor X/X_SIZE \rfloor)+(\lfloor Y/Y_SIZE \rfloor+1)*(\lceil NUM_COL/X_SIZE \rceil+1)$", and "$P3=(\lfloor X/X_SIZE \rfloor+1)+(\lfloor Y/Y_SIZE \rfloor+1)*(\lceil NUM_COL/X_SIZE \rceil+1)$", where P0, P1, P2 and P3 represent the indexes of the pixel correction data for the adjacent representative pixels, X_SIZE represents the row direction length of the selected sampling window, Y_SIZE represents the column direction length of the selected sampling window, X represents the row direction position of the each pixel, Y represents the column direction position of the each pixel, and NUM_COL represents the number of pixel columns of the display panel. Thus, as illustrated in FIGS. 3A and 4, in a case where the 2*32 sampling window is selected with respect to a display device having a display resolution of about 3820*2160 (i.e., a ultra definition (UD) resolution), with respect to a pixel PX(2,2) in a second pixel row and a second pixel column, because X_SIZE is 2, Y_SIZE is 32, X is 1, Y is 1, and NUM_COL is 3820, P0 may be 0 (=0+0*(1921)), P1 may be 1 (=1+0*(1921)), P2 may be 1921 (=0+1*(1921)), and P3 may be 1922 (=1+1*(1921)). Thus, with respect to the pixel PX(2,2), among the correction data CD stored in the correction data memory 110, first pixel correction data having an index of 0, or the first pixel correction data for a representative pixel PX(1,1) located at top left from the pixel PX(2,2), second pixel correction data having an index of 1, or the second pixel correction data for a representative pixel PX(1,3) located at top right from the pixel PX(2,2), third pixel correction data having an index of 1921, or the third pixel correction data for a representative pixel PX(33,1) located at bottom left from the pixel PX(2,2), and fourth pixel correction data having an index of 1922, or the fourth pixel correction data for a representative pixel PX(33,3) located at bottom right from the pixel PX(2,2). As described above, because the plurality of pixel correction data stored in the correction data memory 110 may have the one-dimensional indexes, and the correction calculator 120 may calculate the indexes using the equations described above, the pixel correction data suitable for the selected sampling window may be extracted with respect to each pixel even if any one of the plurality of sampling windows is selected.

Further, the correction calculator 120 (e.g., the space interpolator 150) may perform the bilinear interpolation using an equation, "$CD[P0]+((X \% X_SIZE)/X_SIZE))*(CD[P1]-CD[P0])+((Y \% Y_SIZE)/Y_SIZE))*(CD[P2]-CD[P0])+((X \% X_SIZE)*(Y \% Y_SIZE)/X_SIZE*Y_SIZE))*(CD[P0]+CD[P3]-CD[P1]-CD[P2])$", where CD[P0], CD[P1], CD[P2] and CD[P3] are the pixel correction data having the indexes of P0, P1, P2 and P3. In the example of FIGS. 3A and 4, pixel correction data for the pixel PX(2,2) may be determined by performing the bilinear interpolation on the extracted pixel correction data having the indexes of 0, 1, 1921 and 1922, or on CD[0], CD[1], CD[1921] and CD[1922], and thus may be determined as "$CD[0]+(1/2)*(CD[1]-CD[0])+(1/32))*(CD[P2]-CD[0])+(1/64)*(CD[0]+CD[1922]-CD[1]-CD[1911])$". Accordingly, although not the correction data for each pixel, but the correction data CD (i.e., the pixel correction data) for one representative pixel per pixel block may be stored in the correction data memory 110, the image data IDAT for each pixel may be accurately corrected.

In some example embodiments, the correction data CD stored in the correction data memory 110 may be obtained not at all the gray levels (e.g., 255 gray levels), but at reference gray levels. For example, as illustrated in FIG. 5, the correction data CD may be obtained at ten reference gray levels, or 0-gray level 0G, 16-gray level 16G, 24-gray level 24G, 32-gray level 32G, 64-gray level 64G, 128-gray level 128G, 160-gray level 160G, 192-gray level 192G, 224-gray level 224G and 255-gray level 255G. Further, the bilinear interpolation may be performed at each of the plurality of reference gray levels 0G, 16G, 24G, 32G, 64G, 128G, 160G, 192G, 224G and 255G, and the correction calculator 120 (e.g., the gray interpolator 160) may correct the image data IDAT for each pixel by further performing the linear interpolation between gray levels on results of the bilinear interpolation at the plurality of reference gray levels 0G, 16G, 24G, 32G, 64G, 128G, 160G, 192G, 224G and 255G. For example, in a case where the image data IDAT for one pixel represents 40-gray level, the gray interpolator 160 may correct the image data IDAT for the pixel by performing the linear interpolation on the results of the bilinear interpolation at the 32-gray level 32G and the 64-gray level 64G.

As described above, the image data correcting device 100 according to example embodiments may correct the image data IDAT based on the correction data CD that may be obtained using the sampling window selected based on the luminance distribution of the display device from among the plurality of different sampling windows. Accordingly, the sampling window suitable for each of display devices having different luminance distributions may be used, and optimal or desired mura correction suitable for each display device may be performed.

Figure 6:
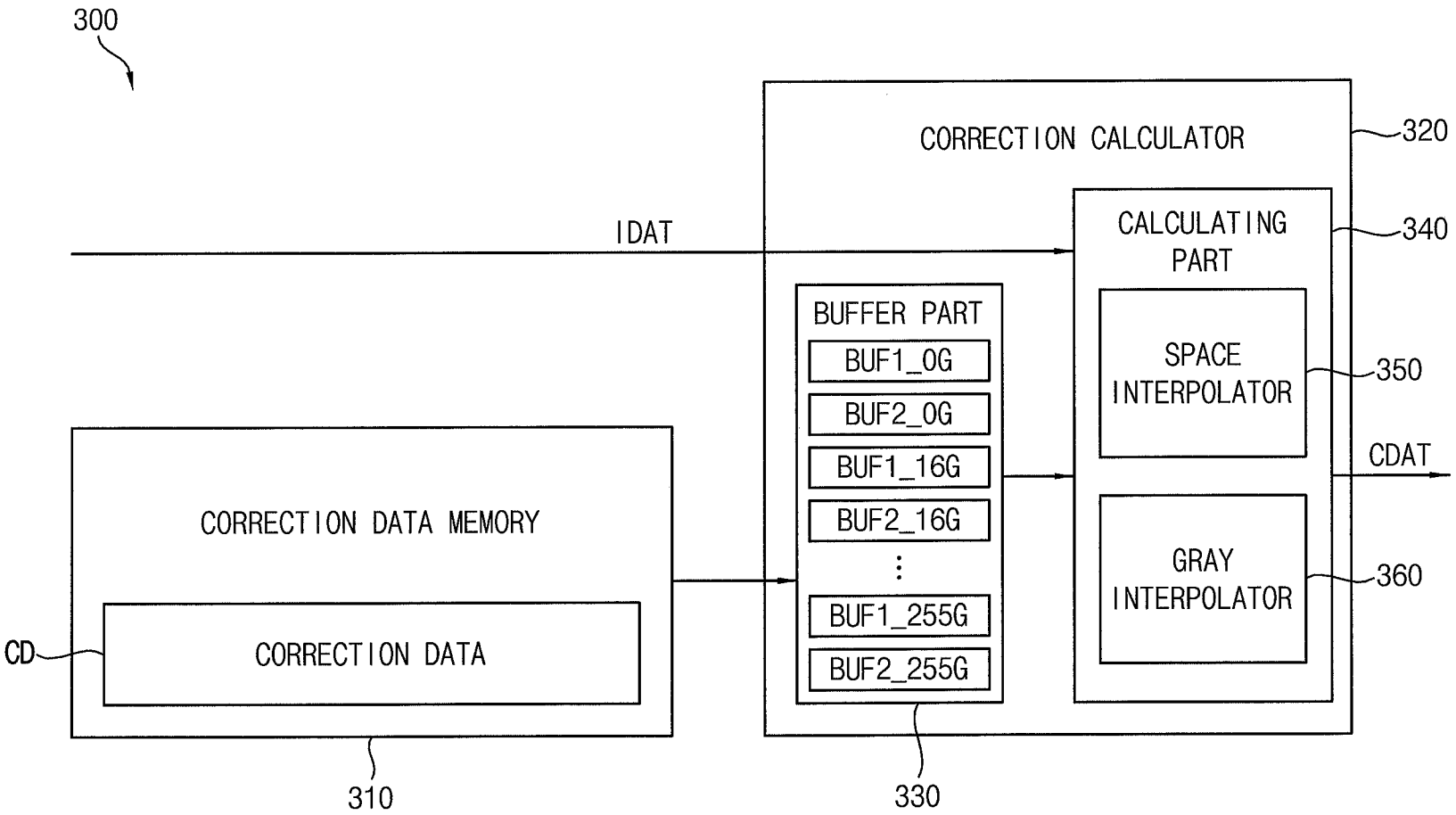
FIG. 6 is a block diagram illustrating an image data correcting device according to example embodiments.

FIG. 6 is a block diagram illustrating an image data correcting device according to example embodiments, and FIG. 7 is a diagram illustrating an example of a plurality of sampling windows respectively corresponding to a plurality of reference gray levels.

Referring to FIG. 6, an image data correcting device 300 included in a display device according to example embodiments may include a correction data memory 310 and a correction calculator 320.

The correction data memory 310 may store correction data CD that are obtained, with respect to the display device, using a plurality of sampling windows respectively at a plurality of reference gray levels (e.g., as illustrated in FIG. 5, 0-gray level G, 16-gray level 16G, 24-gray level 24G, 32-gray level 32G, 64-gray level 64G, 128-gray level 128G, 160-gray level 160G, 192-gray level 192G, 224-gray level 224G and 255-gray level 255G).

In some example embodiments, the plurality of reference gray levels may include a first reference gray level and a second reference gray level higher than the first reference gray level. The plurality of sampling windows may include a first sampling window corresponding to the first reference gray level and a second sampling window corresponding to the second reference gray level. The second sampling window may have a size greater than that of the first sampling window. For example, a sampling window having a relatively small size may be used at a relatively low reference gray level, and thus the correction data CD having a high resolution may be obtained at the relatively low reference gray level where luminance uniformity is relatively low, thereby performing mura correction more accurately. Further, a sampling window having a relatively large size may be used at a relatively high reference gray level, and thus the correction data CD having a low resolution may be obtained at the relatively high reference gray level where a mura defect is hardly perceived, thereby reducing a memory size of the correction data memory 310.

For example, as illustrated in FIG. 7, the correction data CD may be obtained at ten reference gray levels (e.g., 0-gray level 0G, 16-gray level 16G, 24-gray level 24G, 32-gray level 32G, 64-gray level 64G, 128-gray level 128G, 160-gray level 160G, 192-gray level 192G, 224-gray level 224G and 255-gray level 255G). Further, the correction data CD may be obtained using a 4*4 sampling window at the 0-gray level 0G and the 16-gray level 16G. The correction data CD may also be obtained using a 4*8 sampling window at the 24-gray level 24G. The correction data CD may be obtained using a 8*8 sampling window at the 32-gray level 32G. The correction data CD may be obtained using a 16*16 sampling window at the 64-gray level 64G, the 128-gray level 128G, and the 160-gray level 160G. The correction data CD may also be obtained using a 32*32 sampling window at the 192-gray level 192G and the 224-gray level 224G. The correction data CD may be obtained using a 64*64 sampling window at the 255-gray level 255G. Accordingly, at the relatively low reference gray level, such as the 0-gray level 0G and the 16-gray level 16G, the sampling window may have a relatively small size, such as the 4*4 sampling window, and thus the mura correction may be performed more accurately. Further, at the relatively high reference gray level, such as the 255-gray level 255G, the sampling window may have a relatively large size, such as the 64*64 sampling window, and thus the memory size of the correction data memory 310 may be reduced.

The correction calculator 320 may receive image data IDAT from an external host processor, may select at least one sampling window according to a gray level of the image data IDAT from among the plurality of sampling windows, and may correct the image data IDAT based on the correction data CD for pixels at positions corresponding to the selected sampling window. In some example embodiments, the correction calculator 320 may include a buffer part 330 that temporarily stores the correction data CD, and a calculating part 340 that corrects the image data IDAT based on the correction data CD stored in the buffer part 330.

In some example embodiments, the buffer part 330 of the correction calculator 320 may include a plurality of correction data buffers BUF1_0G, BUF2_0G, BUF1_16G, BUF2_16G, . . . , BUF1_255G and BUF2_255G that temporarily store the correction data CD at the plurality of reference gray levels, respectively. For example, the plurality of reference gray levels may include a first reference gray level (e.g., the 0-gray level 0G), and a second reference gray level (e.g., the 255-gray level 255G) higher than the first reference gray level, and the buffer part 330 may include a first correction data buffer (e.g., BUF1_0G and BUF2_0G) that temporarily stores the correction data CD at the first reference gray level, and a second correction data buffer (e.g., BUF1_255G and BUF2_255G) that temporarily stores the correction data CD at the second reference gray level. In this case, the correction data CD at the second reference gray level may be obtained using a sampling window having a size larger than that of a sampling window used to obtain the correction data CD at the first reference gray level, and thus the second correction data buffer (e.g., BUF1_255G and BUF2_255G) may have a size less than that of the first correction data buffer (e.g., BUF1_0G and BUF2_0G).

In some example embodiments, the buffer part 330 of the correction calculator 320 may include two correction data buffers BUF1_XG and BUF2_XG per each of the plurality of reference gray levels, and each of the two correction data buffers may temporarily store the correction data CD corresponding to representative pixels in one row. For example, the buffer part 330 of the correction calculator 320 may include two correction data buffers BUF1_0G and BUF2_0G for storing the correction data CD at the 0-gray level 0G, two correction data buffers BUF1_16G and BUF2_16G for storing the correction data CD at the 16-gray level 16G, and two correction data buffers BUF1_255G and BUF2_255G for storing the correction data CD at the 255-gray level 255G. Further, each time the image data IDAT for the pixels in rows corresponding to a column direction length of the sampling window corresponding to each of the plurality of reference gray levels are received, one of the two correction data buffers may be updated. For example, with respect to the two correction data buffers BUF1_0G and BUF2_0G for the 0-gray level 0G, in a case where the 4*4 sampling window is used at the 0-gray level 0G, each time the image data IDAT for four pixel rows are received, one of the two correction data buffers BUF1_0G and BUF2_0G may be alternately updated. Further, for example, with respect to the two correction data buffers BUF1_255G and BUF2_255G for the 255-gray level 255G, in a case where the 64*64 sampling window is used at the 255-gray level 255G, each time the image data IDAT for sixty four pixel rows may be received, one of the two correction data buffers BUF1_255G and BUF2_255G may be alternately updated. Thus, because the mura correction for pixels in one pixel row may require the correction data CD for representative pixels only in two pixel rows adjacent to the one pixel row, the buffer part 330 may include the two correction data buffers per each reference gray level. Further, because the mura correction for pixel rows corresponding to the column direction length of the sampling window may require the same correction data CD for the representative pixels in the same two pixel rows, and the mura correction for the next pixel row may require the correction data CD for the representative pixels in one of the two pixel rows and for the representative pixels in the next pixel row, one of the two correction data buffers may be updated each that the image data IDAT for the pixel rows corresponding to the column direction length of the sampling window may be received.

The calculating part 340 may include a space interpolator 350 that performs a bilinear interpolation on the correction data CD for different representative pixels, and a gray interpolator 360 that may perform a linear interpolation on the correction data CD at different reference gray levels. The space interpolator 350 may generate the correction data CD for all the pixels included in the display panel by performing, with respect to each pixel of the display panel, the bilinear interpolation on pixel correction data for representative pixels adjacent to the each pixel from among a plurality of pixel correction data included in the correction data CD at each of the plurality of reference gray levels. Further, the gray interpolator 360 may receive, with respect to the each pixel, the correction data CD at two of the reference gray levels adjacent to the gray level of the image data IDAT for the each pixel from among the correction data CD at the plurality of reference gray levels from the space interpolator 350, and may correct the image data IDAT for the each pixel by performing the linear interpolation on the correction data CD at the two of the reference gray levels.

In some example embodiments, the space interpolator 350 may generate, with each pixel, the correction data CD for the each pixel by performing the bilinear interpolation on pixel correction data for four representative pixels adjacent to the each pixel. For example, the space interpolator 350 may perform the bilinear interpolation using an equation, "CD[P0]+((X % X_SIZE)/X_SIZE))*(CD[P1]−CD[P0])+((Y % Y_SIZE)/Y_SIZE))*(CD[P2]−CD[P0])+((X % X_SIZE)*(Y % Y_SIZE)/X_SIZE*Y_SIZE))*(CD[P0]+CD[P3]−CD[P1]−CD[P2])", where P0, P1, P2 and P3 represent indexes of the pixel correction data for the adjacent representative pixels, CD[P0], CD[P1], CD[P2] and CD[P3] are the pixel correction data having the indexes of P0, P1, P2 and P3, X_SIZE represents a row direction length of the sampling window, Y_SIZE represents a column direction length of the sampling window, X represents a row direction position of the each pixel, Y represents a column direction position of the each pixel, and NUM_COL represents a number of pixel columns of the display panel.

In some example embodiments, the gray interpolator 360 may perform the linear interpolation on the correction data CD at the two of the reference gray levels using an equation, "Y1+(X_I−X1)*(Y2−Y1)/(X2−X1)", where X_I represents the image data for the each pixel, X1 represents a first reference gray level among the two of the reference gray levels, X2 represents a second reference gray level among the two of the reference gray levels, Y1 represents the correction data CD for the each pixel at the first reference gray level, and Y2 represents the correction data CD for the each pixel at the second reference gray level.

As described above, the image data correcting device 300 according to example embodiments may correct the image data IDAT based on the correction data CD that are obtained using the plurality of sampling windows respectively at the plurality of reference gray levels, for example using a sampling window having a relatively small size at a relatively low reference gray level and a sampling window having a relatively large size at a relatively high reference gray level. Accordingly, accurate mura correction may be performed at the relatively low reference gray level, the correction data CD having a small data size may be obtained at the relatively high reference gray level, and optimal or desired mura correction suitable for the gray level of image data IDAT may be performed.

Figure 8:
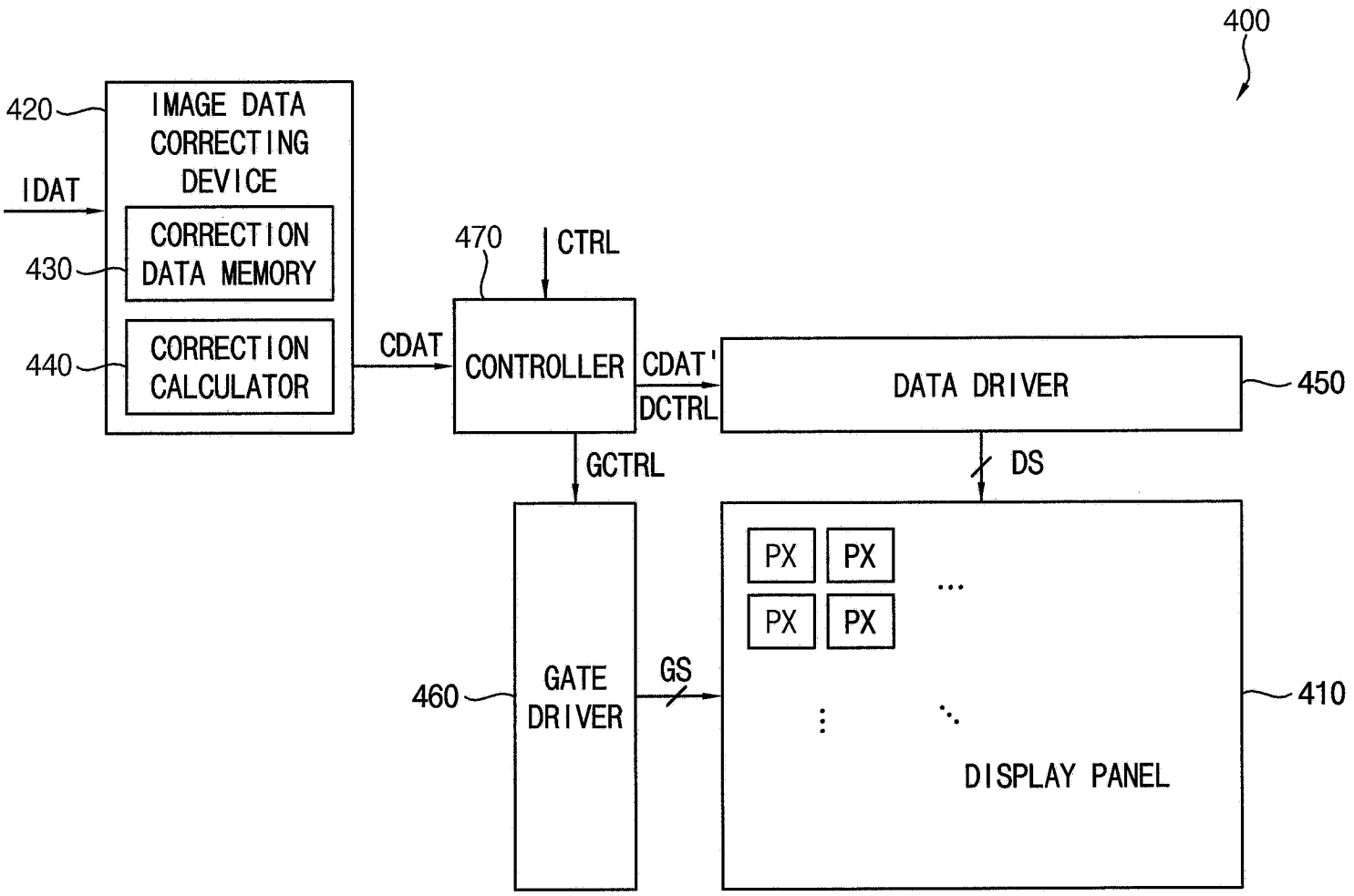
FIG. 8 is a block diagram illustrating a display device according to example embodiments.

FIG. 8 is a block diagram illustrating a display device according to example embodiments.

Referring to FIG. 8, a display device 400 according to example embodiments may include a display panel 410 which may include a plurality of pixels PX, a data driver 450 which provides data signals DS to the plurality of pixels PX, a gate driver 460 which provides gate signals GS to the plurality of pixels PX, a controller 470 which may control an operation of the display device 400, and an image data correcting device 420 which corrects image data IDAT.

The display panel 410 may include a plurality of data lines, a plurality of gate lines, and the plurality of pixels PX coupled to the plurality of data lines and the plurality of gate lines. In some example embodiments, each pixel PX may include a switching transistor and a liquid crystal capacitor coupled to the switching transistor, and the display panel 410 may be a liquid crystal display (LCD) panel. However, the display panel 410 may not be limited to the LCD panel, and may be any suitable display panel.

The data driver 450 may generate the data signals DS based on output image data CDAT' and a data control signal DCTRL output from the controller 470, and may provide the data signals DS to the plurality of pixels PX. For example, the data control signal DCTRL may include, but not be limited to, an output data enable signal, a horizontal start signal and a load signal. In some example embodiments, the data driver 450 may be implemented with one or more data integrated circuits (ICs). Further, according to some example embodiments, the data driver 450 may be mounted directly on the display panel 410, or may be coupled to the display panel 410 in a form of a tape carrier package (TCP). In other example embodiments, the data driver 450 may be integrated in a peripheral portion of the display panel 410.

The gate driver 460 may generate the gate signals GS based on a gate control signal GCTRL from the controller 470, and may provide the gate signals GS to the plurality of pixels PX. In some example embodiments, the gate control signal GCTRL may include, but not be limited to, a frame start signal and a gate clock signal. In some example embodiments, the gate driver 460 may be implemented as an amorphous silicon gate (ASG) driver integrated in the peripheral portion of the display panel 410. In other example embodiments, the gate driver 460 may be implemented with one or more gate ICs. Further, according to some example embodiments, the gate driver 460 may be mounted directly on the display panel 410, or may be coupled to the display panel 410 in the form of the TCP.

The controller (e.g., a timing controller; TCON) 470 may receive a control signal CTRL from an external host processor (e.g., a graphic processing unit (GPU) or a graphic card), and may receive corrected image data CDAT from the image data correcting device 420. In some example embodiments, the control signal CTRL may include, but not be limited to, a vertical synchronization signal, a horizontal synchronization signal, an input data enable signal, a master clock signal, etc. The controller 470 may generate the gate control signal GCTRL, the data control signal DCTRL and the output image data CDAT' based on the control signal CTRL and the corrected image data CDAT. The controller 470 may control an operation of the data driver 450 by providing the data control signal DCTRL and the output image data CDAT' to the data driver 450, and may control an operation of the gate driver 460 by providing the gate control signal GCTRL to the gate driver 460.

The image data correcting device 420 may include a correction data memory 430 that stores correction data, and a correction calculator 440 that receives image data IDAT from the external host processor, that selects a sampling window among a plurality of sampling windows that are different from each other, and that corrects the image data IDAT based on the correction data for the pixels at positions corresponding to the selected sampling window. In some example embodiments, the correction data memory 430 may further store sampling window select information indicating the selected sampling window, and the correction calculator 440 may select the sampling window based on the sampling window select information among the plurality of sampling windows. Accordingly, the sampling window may be suitably selected for respective display devices having different luminance distributions, and optimal or desired mura correction suitable for each display device may be performed. In other example embodiments, the correction calculator 440 may select the sampling window according to a gray level of the image data IDAT among the plurality of sampling windows. Accordingly, optimal or desired mura correction suitable for the gray level of image data IDAT may be performed. In some example embodiments, the image data correcting device 420 and the controller 470 may be implemented with separate devices or separate integrated circuits. In other example embodiments, the image data correcting device 420 may be included in the controller 470, and the controller 470 including the image data correcting device 420 may be implemented with one integrated circuit.

Figure 9:
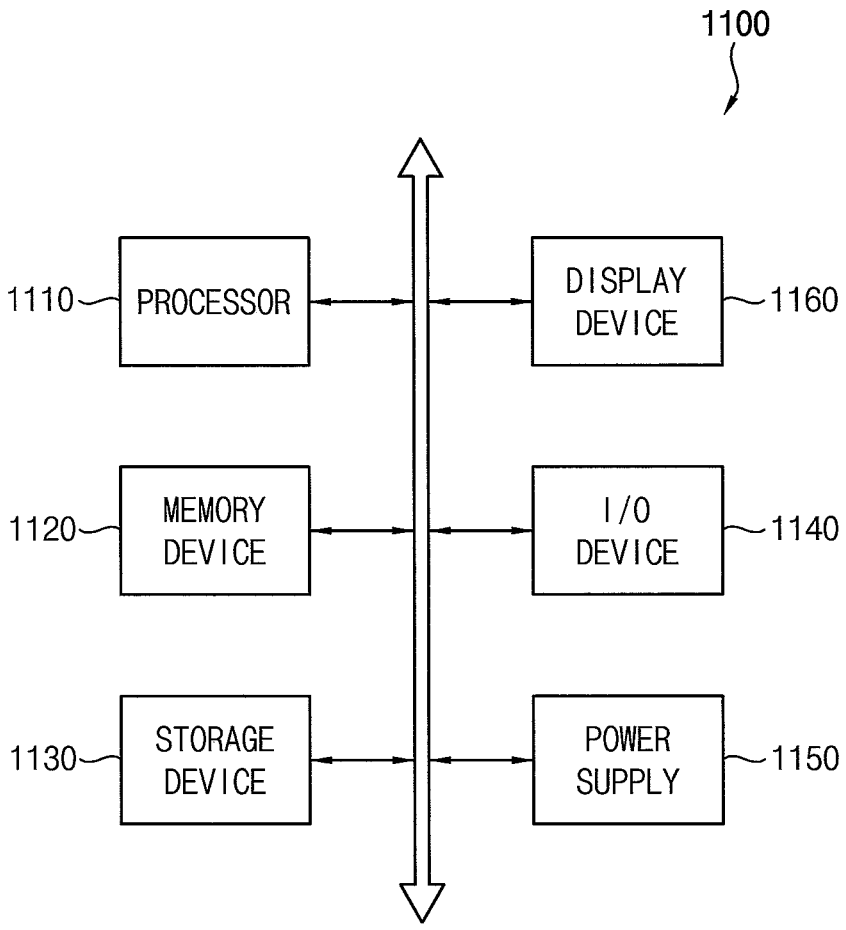
FIG. 9 is a block diagram illustrating an electronic device including a display device according to example embodiments.

FIG. 9 is a block diagram illustrating an electronic device including a display device according to example embodiments.

Referring to FIG. 9, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In some example embodiments, the display device 1160 may correct image data based on correction data that are obtained using a sampling window selected based on a luminance distribution of the display device 1160 among a plurality of sampling windows. Accordingly, optimal or desired mura correction suitable for each display device 1160 may be performed. In other example embodiments, the display device 1160 may correct the image data based on the correction data that are obtained using a plurality of sampling windows respectively at a plurality of reference gray levels. Accordingly, optimal or desired mura correction suitable for a gray level of the image data may be performed.

The inventive concepts may be applied to any display device 1160 performing the mura correction, and any electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "coupled to" or "adjacent to" another element or layer, it can be directly coupled to or adjacent to the other element or layer, or one or more intervening elements or layers may be present. In contrast, when an element or layer is referred to as being "directly coupled to", or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art. Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

As used herein, the terms "use," "using," and "used" may be considered synonymous with the terms "utilize," "utilizing," and "utilized," respectively.

The term "processing unit" or "processor" is used herein to include any combination of hardware, firmware, and software, employed to process data or digital signals. Processing unit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs).

The electronic or electric devices and/or any other relevant devices or components according to embodiments of the present disclosure described herein, such as, for example, an external controller, a timing controller, power management circuit, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. An image data correcting device included in a display device, the image data correcting device comprising:

a correction data memory configured to store sampling window select information indicating a sampling window selected from a plurality of sampling windows that are different from each other, and correction data obtained utilizing the selected sampling window with respect to the display device; and a correction calculator configured to receive image data, and to correct the image data based on the correction data for pixels at positions corresponding to the selected sampling window indicated by the sampling window select information, wherein the plurality of sampling windows comprises different row direction lengths and different column direction lengths, and have a same size.

2. The image data correcting device of claim 1, wherein the selected sampling window indicated by the sampling window select information is selected based on a luminance distribution of the display device from among the plurality of sampling windows.

3. The image data correcting device of claim 1, wherein a display panel of the display device is divided into a plurality of pixel blocks, each corresponding to the selected sampling window indicated by the sampling window select information, and wherein the correction data stored in the correction data memory comprises, with respect to each pixel block, a pixel correction data at a plurality of reference gray levels for a representative pixel from among the pixels included in the each pixel block.

4. The image data correcting device of claim 1, wherein the sampling window select information comprises a row direction length and a column direction length of the selected sampling window.

5. An image data correcting device included in a display device, the image data correcting device comprising:

a correction data memory configured to store sampling window select information indicating a sampling window selected from a plurality of sampling windows that are different from each other, and correction data obtained utilizing the selected sampling window with respect to the display device; and a correction calculator configured to receive image data, and to correct the image data based on the correction data for pixels at positions corresponding to the selected sampling window indicated by the sampling window select information, wherein a display panel of the display device is divided into a plurality of pixel blocks, each corresponding to the selected sampling window indicated by the sampling window select information, wherein the correction data stored in the correction data memory comprises, with respect to each pixel block, a pixel correction data at a plurality of reference gray levels for a representative pixel from among the pixels included in the each pixel block, and wherein the representative pixel is a pixel located at a top left corner from among the pixels included in the each pixel block.

6. An image data correcting device included in a display device, the image data correcting device comprising:

a correction data memory configured to store sampling window select information indicating a sampling window selected from a plurality of sampling windows that are different from each other, and correction data obtained utilizing the selected sampling window with respect to the display device; and a correction calculator configured to receive image data, and to correct the image data based on the correction data for pixels at positions corresponding to the selected sampling window indicated by the sampling window select information, wherein the sampling window select information comprises a row direction length and a column direction length of the selected sampling window, wherein a display panel of the display device is divided into a plurality of pixel blocks based on the selected sampling window, wherein the correction data comprises a plurality of pixel correction data for a plurality of representative pixels respectively corresponding to the plurality of pixel blocks, and wherein the correction calculator is configured to extract, with respect to each pixel of the display panel, the plurality of pixel correction data for the representative pixels that are adjacent to the each pixel based on the row direction length of the selected sampling window, the column direction length of the selected sampling window, a row direction position of the each pixel, and a column direction position of the each pixel, and to correct the image data for the each pixel by performing a bilinear interpolation on the pixel correction data for the adjacent representative pixels.

7. The image data correcting device of claim 6, wherein the correction calculator is configured to extract the pixel correction data for the adjacent representative pixels utilizing equations, $$P0=(X/X_SIZE)+(Y/Y_SIZE)*(NUM_COL/X_SIZE+1),$$

$$P1=(X/X_SIZE+1)+(Y/Y_SIZE)*(NUM_COL/X_SIZE+1),$$

$$P2=(X/X_SIZE)+(Y/Y_SIZE+1)*(NUM_COL/X_SIZE+1), \text{ and}$$

$$P3=(X/X_SIZE+1)+(Y/Y_SIZE+1)*(NUM_COL/X_SIZE+1),$$

where P0, P1, P2 and P3 represent indexes of the pixel correction data for the adjacent representative pixels, X_SIZE represents the row direction length of the selected sampling window, Y_SIZE represents the column direction length of the selected sampling window, X represents the row direction position of the each pixel, Y represents the column direction position of the each pixel, and NUM_COL represents a number of pixel columns of the display panel.

8. The image data correcting device of claim 7, wherein the correction calculator is configured to perform the bilinear interpolation utilizing an equation, $$CD[P0]+((X\ \%\ X_SIZE)/X_SIZE))*(CD[P1]-CD[P0])+((Y\ \%\ Y_SIZE)/Y_SIZE))*(CD[P2]-CD[P0])+((X\ \%\ X_SIZE)*(Y\ \%\ Y_SIZE)/X_SIZE*Y_SIZE))*(CD[P0]+CD[P3]-CD[P1]-CD[P2]),$$

where CD[P0], CD[P1], CD[P2] and CD[P3] are the pixel correction data having the indexes of P0, P1, P2 and P3.

9. The image data correcting device of claim 6, wherein the correction calculator is configured to perform the bilinear interpolation at each of a plurality of reference gray levels, and to correct the image data for the each pixel by further performing a linear interpolation between gray levels on results of the bilinear interpolation at the plurality of reference gray levels.

10. An image data correcting device included in a display device, the image data correcting device comprising:

a correction data memory configured to store correction data that is obtained with respect to the display device utilizing a plurality of sampling windows at a plurality of reference gray levels, respectively; and a correction calculator configured to receive image data, to select at least one sampling window according to a gray level of the image data from among the plurality of sampling windows, and to correct the image data based on the correction data for pixels at positions corresponding to the selected sampling window, wherein the correction calculator comprises:

a plurality of correction data buffers configured to temporarily store the correction data at the plurality of reference gray levels;

a space interpolator configured to generate the correction data for all the pixels included in a display panel of the display device by performing, with respect to each pixel of the display panel, a bilinear interpolation on a plurality of pixel correction data for representative pixels that are adjacent to the each pixel from among the plurality of pixel correction data included in the correction data at each of the plurality of reference gray levels; and a gray interpolator configured to receive, with respect to the each pixel, the correction data at two of the reference gray levels that are adjacent to the gray level of the image data for the each pixel from among the correction data at the plurality of reference gray levels from the space interpolator, and to correct the image data for the each pixel by performing a linear interpolation on the correction data at the two of the reference gray levels.

11. The image data correcting device of claim 10, wherein the plurality of reference gray levels comprises a first reference gray level, and a second reference gray level higher than the first reference gray level, wherein the plurality of sampling windows comprises a first sampling window corresponding to the first reference gray level, and a second sampling window corresponding to the second reference gray level, and wherein the second sampling window is greater in size than that of the first sampling window.

12. The image data correcting device of claim 10, wherein the plurality of reference gray levels comprises a first reference gray level, and a second reference gray level higher than the first reference gray level, wherein the plurality of correction data buffers comprises a first correction data buffer configured to temporarily store the correction data at the first reference gray level, and a second correction data buffer configured to temporarily store the correction data at the second reference gray level, and wherein the second correction data buffer is less in size than that of the first correction data buffer.

13. The image data correcting device of claim 10, wherein the plurality of correction data buffers comprises two correction data buffers per each of the plurality of reference gray levels, and each of the two correction data buffers are configured to temporarily store the correction data corresponding to representative pixels in one row, and to update one of the two correction data buffers each time the correction calculator receives image data for the pixels in rows corresponding to a column direction length of the sampling window corresponding to each of the plurality of reference gray levels.

14. The image data correcting device of claim 10, wherein the space interpolator is configured to perform the bilinear interpolation utilizing an equation, $$CD[P0]+((X\ \%\ X_SIZE)/X_SIZE))*(CD[P1]-CD[P0])+((Y\ \%\ Y_SIZE)/Y_SIZE))*(CD[P2]-CD[P0])+((X\ \%\ X_SIZE)*(Y\ \%\ Y_SIZE)/X_SIZE*Y_SIZE))*(CD[P0]+CD[P3]-CD[P1]-CD[P2]),$$

where P0, P1, P2 and P3 represent indexes of the pixel correction data for the adjacent representative pixels, CD[P0], CD[P1], CD[P2] and CD[P3] are the pixel correction data having the indexes of P0, P1, P2 and P3, X_SIZE represents a row direction length of the sampling window, Y_SIZE represents a column direction length of the sampling window, X represents a row direction position of the each pixel, Y represents a column direction position of the each pixel, and NUM_COL represents a number of pixel columns of the display panel.

15. The image data correcting device of claim 10, wherein the gray interpolator is configured to perform the linear interpolation on the correction data at the two of the reference gray levels utilizing an equation, $$Y1+(X_I-X1)*(Y2-Y1)/(X2-X1),$$

where X_I represents the image data for the each pixel, X1 represents a first reference gray level from among the two of the reference gray levels, X2 represents a second reference gray level from among the two of the reference gray levels, Y1 represents the correction data for the each pixel at the first reference gray level, and Y2 represents the correction data for the each pixel at the second reference gray level.

16. A display device comprising:

a display panel comprising pixels; and an image data correcting device comprising a correction data memory configured to store correction data that is obtained with respect to the display device utilizing a plurality of sampling windows at a plurality of reference gray levels, respectively, and a correction calculator configured to receive image data, to select a sampling window according to a gray level of the image data from among a plurality of sampling windows, and to correct the image data based on the correction data for the pixels at positions corresponding to the selected sampling window, wherein the plurality of reference gray levels comprises a first reference gray level, and a second reference gray level higher than the first reference gray level, wherein the plurality of sampling windows comprises a first sampling window corresponding to the first reference gray level, and a second sampling window corresponding to the second reference gray level, and wherein the second sampling window is greater in size than that of the first sampling window.

17. The display device of claim 16, wherein the correction data memory is configured to store sampling window select information indicating the selected sampling window, and wherein the correction calculator is configured to select the sampling window based on the sampling window select information from among the plurality of sampling windows.

* * * * *